US006926289B2

(12) United States Patent
Wang

(10) Patent No.: US 6,926,289 B2
(45) Date of Patent: Aug. 9, 2005

(54) MULTIFUNCTIONAL SHOES FOR WALKING AND SKATING WITH SINGLE ROLLER

(76) Inventor: Guohua Wang, Dong Guan Shang an Hong Sporting Goods Factoury, Qiatou 3rd Industrial Zone, Houjie, Dongguan City, Guandong Province, 523950 (CN)

( * ) Notice: Subject to any disclaimer, the term of this patent is extended or adjusted under 35 U.S.C. 154(b) by 0 days.

(21) Appl. No.: 10/117,269

(22) Filed: Apr. 5, 2002

(65) Prior Publication Data

US 2003/0132586 A1 Jul. 17, 2003

(30) Foreign Application Priority Data

Jan. 16, 2002 (CN) ..... 02200817 U

(51) Int. Cl.[7] ..... A63C 17/20
(52) U.S. Cl. ..... 280/7.13; 280/11.24; 36/115
(58) Field of Search ..... 280/7.13, 841, 280/11.19, 11.24, 11.27, 11.28; 36/115

(56) References Cited

U.S. PATENT DOCUMENTS

| | | | |
|---|---|---|---|
| 132,474 | A | 10/1872 | Lindley |
| 202,191 | A | 4/1878 | Proctor |
| 234,030 | A | 11/1880 | Hadley et al. |
| 579,577 | A | 3/1897 | Hanscom |
| 702,476 | A | 6/1902 | Price |
| 875,560 | A | 12/1907 | Vaughan |
| 881,079 | A | 3/1908 | Jolitz |
| 892,152 | A | 6/1908 | Harman |
| 966,821 | A | 8/1910 | Gaw |
| 1,051,880 | A | 2/1913 | Glenn |
| 1,056,091 | A | 3/1913 | Dickson |
| 1,068,575 | A | 7/1913 | Demorey et al. |
| 1,189,329 | A | 7/1916 | Winagle |
| 1,260,901 | A | 3/1918 | Hayhurst |

(Continued)

FOREIGN PATENT DOCUMENTS

| | | |
|---|---|---|
| CA | 1 138 194 | 12/1982 |
| CA | 1 239 017 | 7/1988 |
| CA | 2258978 | 7/2000 |
| CA | 2258980 | 7/2000 |
| CN | 2317906 Y | 10/1997 |
| DE | 254775 | 12/1912 |
| DE | 456796 | 3/1928 |
| DE | 723266 | 8/1942 |
| DE | 821323 | 11/1951 |
| DE | 296 13 508 | 8/1996 |
| DE | 197 55 340 | 6/1999 |
| FR | 1.194.886 | 4/1958 |
| FR | 2.196.826 | 8/1973 |
| GB | 117176 | 7/1918 |
| GB | 150512 | 3/1920 |
| GB | 216903 | 1/1925 |
| WO | WO 98/01051 | 1/1998 |

*Primary Examiner*—Christopher Ellis
*Assistant Examiner*—Jeff Restifo
(74) *Attorney, Agent, or Firm*—Knobble Yoshida & Dunleavy, LLC

(57) ABSTRACT

The multifunctional shoes for walking and skating with single roller mainly include a pulley assembly and the shoe body. The pulley assembly consists of a bracket, a roller, a shaft, pushing rods, springs, pushing rod assembly and fastening bolts. The shaft passes through the center of the roller fixing the roller in the slots of the bracket. The pushing rods and the springs are provided on the top of the bracket with the pushing rod assembly provided in the bracket. The pulley assembly is secured to the shoe by fastening bolts. The pushing rod assembly includes a pushing rod head, a rear connecting plate, springs, connecting bolts of the pushing rods, pushing rods, a front connecting plate and fastening bolts with the pushing rods connecting bolts and pushing rods welded to the front connecting plate while the springs seated on the connecting bolts of the pushing rods. The roller can be extended and retrieved in the direction perpendicular to the ground. Switching between walking and skating is carried out by striking the rear parts of the shoes against the wall or other object.

8 Claims, 3 Drawing Sheets

U.S. PATENT DOCUMENTS

| | | | |
|---|---|---|---|
| 1,369,849 | A | 3/1921 | Spencer |
| 1,428,232 | A | 9/1922 | Holmen |
| 1,592,692 | A | 7/1926 | Hackett |
| 1,600,075 | A | 8/1926 | Stoops |
| 1,636,909 | A | 7/1927 | Haney |
| 1,866,006 | A | 7/1932 | Bergstrand |
| 1,975,661 | A | 10/1934 | Powell |
| 1,984,989 | A | 12/1934 | Reed |
| 2,060,391 | A | 11/1936 | Castagnola |
| 2,095,942 | A | 10/1937 | Wetterstrand |
| 2,113,477 | A | 4/1938 | Gilman |
| 2,114,461 | A | 4/1938 | Agosta et al. |
| 2,114,790 | A | 4/1938 | Venables |
| 2,138,823 | A | 12/1938 | Werkman |
| 2,165,581 | A | 7/1939 | Schroeder |
| D117,918 | S | 12/1939 | Brodick |
| D146,368 | S | 2/1947 | McCaffrey |
| 2,422,228 | A | 6/1947 | Ferrar |
| 2,476,806 | A | 7/1949 | Brandt, Jr. |
| 2,484,935 | A | 10/1949 | De Rooy |
| 2,490,469 | A | 12/1949 | Pittman |
| D161,557 | S | 1/1951 | Walker et al. |
| 2,572,671 | A | 10/1951 | Shaw |
| 2,723,467 | A | 11/1955 | Cassidy |
| 2,897,609 | A | 8/1959 | Bodkin |
| 3,010,732 | A | 11/1961 | Correll |
| 3,027,661 | A | 4/1962 | McCord |
| 3,032,894 | A | 5/1962 | Kennedy et al. |
| 3,112,119 | A | 11/1963 | Sweet |
| 3,176,416 | A | 4/1965 | Seegert |
| 3,306,623 | A | 2/1967 | Weitzner |
| 3,351,353 | A | 11/1967 | Weitzner |
| 3,374,002 | A | 3/1968 | Lewis |
| 3,476,399 | A | 11/1969 | Finn |
| 3,478,447 | A | 11/1969 | Gillead |
| 3,486,250 | A | 12/1969 | Purtle |
| 3,789,523 | A | 2/1974 | Rubin |
| D231,999 | S | 7/1974 | Engman |
| D233,619 | S | 11/1974 | Kelling |
| 3,876,217 | A | 4/1975 | Copier |
| 3,884,485 | A | 5/1975 | Walle |
| 3,934,359 | A | 1/1976 | Fletcher |
| 3,963,251 | A | 6/1976 | Miano |
| 3,983,643 | A | 10/1976 | Schreyer et al. |
| 3,997,179 | A | 12/1976 | de Blois |
| 4,088,334 | A | 5/1978 | Johnson |
| 4,095,817 | A | 6/1978 | Cohen |
| D250,492 | S | 12/1978 | Kish |
| 4,133,548 | A | 1/1979 | Smith |
| 4,138,127 | A | 2/1979 | Kimmell et al. |
| 4,149,735 | A | 4/1979 | Blackburn et al. |
| 4,150,497 | A | 4/1979 | Weber |
| 4,183,547 | A | 1/1980 | Cohen et al. |
| 4,245,406 | A | 1/1981 | Landay et al. |
| 4,295,655 | A | 10/1981 | Landay et al. |
| 4,303,253 | A | 12/1981 | Rottenkolber |
| 4,316,334 | A | 2/1982 | Hunt |
| 4,364,187 | A | 12/1982 | Melendez |
| 4,417,737 | A | 11/1983 | Suroff |
| 4,442,614 | A | 4/1984 | Farberov |
| 4,496,025 | A | 1/1985 | Gattman |
| 4,523,767 | A | 6/1985 | Le Page |
| 4,638,575 | A | 1/1987 | Illustrato |
| 4,676,010 | A | 6/1987 | Cheskin |
| 4,691,453 | A | 9/1987 | Tifre |
| 4,699,390 | A | 10/1987 | Cote |
| 4,763,909 | A | 8/1988 | Bergeron |
| 4,783,910 | A | 11/1988 | Boys, II et al. |
| 4,795,181 | A | 1/1989 | Armstrong |
| 4,817,974 | A | 4/1989 | Bergeron |
| 4,841,648 | A | 6/1989 | Shaffer et al. |
| 4,843,741 | A | 7/1989 | Yung-Mao |
| D302,994 | S | 8/1989 | Hawkes et al. |
| 4,887,824 | A | 12/1989 | Zatlin |
| 4,897,939 | A | 2/1990 | Harrington |
| 4,928,982 | A | 5/1990 | Logan |
| 4,947,560 | A | 8/1990 | Fuerst et al. |
| 4,977,691 | A | 12/1990 | Orchard, 3rd |
| 4,988,122 | A | 1/1991 | Saunders |
| 5,056,240 | A | 10/1991 | Sherrill |
| 5,134,791 | A | 8/1992 | Gregory |
| 5,249,376 | A | 10/1993 | Capria |
| D341,179 | S | 11/1993 | Evans, III |
| 5,286,043 | A | 2/1994 | Tkaczyk |
| 5,319,866 | A | 6/1994 | Foley et al. |
| 5,319,869 | A | 6/1994 | McDonald et al. |
| D352,818 | S | 11/1994 | Bailey |
| 5,384,973 | A | 1/1995 | Lyden |
| 5,388,350 | A | 2/1995 | Parker, Jr. |
| 5,392,537 | A | 2/1995 | Goldberg |
| 5,393,077 | A | 2/1995 | Wanous |
| 5,396,675 | A | 3/1995 | Vincent et al. |
| 5,398,970 | A | 3/1995 | Tucky |
| 5,410,821 | A | 5/1995 | Hilgendorf |
| 5,417,444 | A | 5/1995 | Chen |
| 5,425,186 | A | 6/1995 | Hoyt |
| 5,511,824 | A | 4/1996 | Kim |
| 5,527,049 | A | 6/1996 | Ortiz |
| 5,527,050 | A | 6/1996 | Szendel |
| D373,674 | S | 9/1996 | Dolinsky |
| 5,572,804 | A | 11/1996 | Skaja et al. |
| 5,595,004 | A | 1/1997 | Lyden et al. |
| 5,632,104 | A | 5/1997 | Zohar |
| 5,638,614 | A | 6/1997 | Hardy |
| 5,655,316 | A | 8/1997 | Huang |
| 5,682,685 | A | 11/1997 | Terlizzi |
| 5,697,643 | A | 12/1997 | Marasco et al. |
| 5,716,074 | A | 2/1998 | Theodorou |
| 5,716,723 | A | 2/1998 | Van Cleef et al. |
| 5,730,467 | A | 3/1998 | Huang |
| 5,769,432 | A | 6/1998 | Tybinkowski et al. |
| 5,785,327 | A | 7/1998 | Gallant |
| 5,797,609 | A | 8/1998 | Fichepain |
| 5,823,913 | A | 10/1998 | Aruin et al. |
| 5,836,591 | A | 11/1998 | Roderick et al. |
| 5,839,737 | A | 11/1998 | Kruczek |
| D401,739 | S | 12/1998 | James |
| D402,797 | S | 12/1998 | Kracke |
| D404,550 | S | 1/1999 | James |
| 5,881,413 | A | 3/1999 | Throneburg et al. |
| 5,882,018 | A | 3/1999 | Petrosino |
| 5,885,500 | A | 3/1999 | Tawney et al. |
| 5,887,898 | A | 3/1999 | Petrosino |
| D408,123 | S | 4/1999 | James |
| 5,927,729 | A | 7/1999 | Di Filippo et al. |
| 5,927,734 | A | 7/1999 | Horton, II et al. |
| D412,778 | S | 8/1999 | James |
| D412,779 | S | 8/1999 | James |
| D413,193 | S | 8/1999 | James |
| 5,951,049 | A | 9/1999 | Calverley et al. |
| 5,967,552 | A | 10/1999 | Roderick et al. |
| 5,970,631 | A | 10/1999 | Inman |
| 5,997,105 | A | 12/1999 | Wu |
| 6,006,450 | A | 12/1999 | Hayes |
| 6,006,451 | A | 12/1999 | Morris et al. |
| 6,041,525 | A | 3/2000 | Kelley |
| 6,050,357 | A | 4/2000 | Staelin et al. |
| 6,061,930 | A | 5/2000 | Zinovieff |
| 6,070,887 | A | 6/2000 | Cornelius et al. |
| 6,092,305 | A | 7/2000 | Troy et al. |
| 6,115,946 | A | 9/2000 | Morris et al. |

6,120,039 A 9/2000 Clementi
D433,214 S 11/2000 McDowell
6,151,806 A 11/2000 Morris et al.
6,158,150 A 12/2000 Morris et al.
6,195,918 B1 3/2001 Kelley et al.
6,195,920 B1 3/2001 Morris et al.
6,226,900 B1 5/2001 Mazars
6,243,972 B1 6/2001 De France
6,247,251 B1 6/2001 James
6,247,708 B1 6/2001 Hsu
6,250,656 B1 6/2001 Ibarra
6,308,964 B1 10/2001 Chang
6,336,644 B1 * 1/2002 Chu ..... 280/11.233
6,364,322 B1 * 4/2002 Lee ..... 280/11.27
6,386,555 B1 * 5/2002 Kao ..... 280/7.13
6,386,556 B1 * 5/2002 Yeh ..... 280/11.223
6,394,468 B1 * 5/2002 Chiang et al. ..... 280/11.223
6,402,162 B1 * 6/2002 Chiang ..... 280/11.233
6,406,037 B2 * 6/2002 Chang ..... 280/11.19
6,406,038 B2 6/2002 Adams
6,412,791 B1 * 7/2002 Chu ..... 280/11.19
6,450,508 B1 * 9/2002 Chu ..... 280/11.208
6,450,509 B2 * 9/2002 Adams ..... 280/11.24
6,454,279 B1 * 9/2002 Yang ..... 280/11.223
6,464,236 B2 * 10/2002 Chang ..... 280/11.223
6,523,836 B1 * 2/2003 Chang et al. ..... 280/11.223
6,536,785 B2 * 3/2003 Lee ..... 280/11.27
6,629,698 B2 * 10/2003 Chu ..... 280/11.19
2003/0001347 A1 * 1/2003 Chen et al. ..... 280/11.27
2004/0251644 A1 * 12/2004 Wang ..... 280/11.24
2005/0029756 A1 * 2/2005 Lin et al. ..... 280/11.27

* cited by examiner

MULTIFUNCTIONAL SHOES FOR WALKING AND SKATING WITH SINGLE ROLLER

TECHNICAL FIELD

This invention is related to a multifunctional skating shoes of the roller type of skating shoes in sport and recreation field, and particularly to a multifunctional shoes for walking and skating with single roller.

BACKGROUND ART

The existing skating shoes of roller type have four rollers, which cannot be retrieved, but skate. Previously the applicant had made an application for retrievable multifunctional shoes for walking and skating with the rollers to be folded and retrieved by means of an outward pulling mechanism and springs. However, this kind of mechanism is inconvenient to operate. In order to make the rollers folded and retrieved, the wearer must squat down and pull the pressure rod assembly apart with wearer's hands.

In view of the problems of the existing skating shoes of roller type the applicant has provided the present invention based on abundant experience and expertise after constant research and test as well as modification of the samples.

SUMMARY OF THE INVENTION

The main problem which has to be resolved by the invention is: overcoming the shortcomings of the existing skating shoes of roller type and providing a new type of multifunctional shoes for walking and skating with single roller which can be used for walking and skating as well as performing special tricks.

The other problem which has to be resolved by the invention is: providing a new type of multifunctional shoes for walking and skating with a single roller in which the roller can be extended and retrieved in the direction perpendicular to the ground. When the roller is retrieved toward the wearer's body, the full soles contact the ground allowing the shoes to be used for walking; and when the roller is extended toward the ground, only the heels and the roller contact the ground allowing to be used for skating and performing special tricks.

The yet another problem which has to be resolved by the invention is: providing a new type of multifunctional shoes for walking and skating with single roller in which switching from walking to skating can be executed by pressing the rear parts of the shoes against the wall or other objects without the need of hands; so it is very convenient.

The above mentioned problems are overcome by the invention according to the following solutions. Multifunctional shoes for walking and skating with a single roller mainly comprising a roller assembly and a shoe body wherein the roller assembly is fitted in the shoe body.

The following solutions can also be applied by the invention to overcome the above mentioned problems.

The multifunctional shoes for walking and skating with single roller are characterized in that the said roller assembly consists of a bracket, a roller, a shaft, rods, springs, pushing rods assembly and fastening bolts with the shaft passed through the center of the roller securing the roller to the middle of the bracket, and the rods as well as the springs provided on the top of the bracket, the pushing rods assembly provided on the bracket and fixed by the nuts.

The multifunctional shoes for walking and skating with single roller are characterized in that the said pushing rod assembly consists of the pushing rod head, the rear connecting plate, springs, connecting bolts of the pushing rods, pushing rods, the front connecting plate and fastening nuts with the connecting bolts of the pushing rods and the pushing rods welded to the front connecting plate as well as the springs seated on the connecting rods of the pushing rods.

The multifunctional shoes for walking and skating with single roller are characterized in that the said connecting bolts of the front connecting plate pass through the centers of the springs and the connecting threaded holes in the bracket, while the pushing rods welded to the front connecting plate are inserted into the sliding holes of the bracket, also the connecting bolts of the pushing rods are inserted into the holes of the rear connecting plate and fixed by the fastening nuts.

The multifunctional shoes for walking and skating with single roller are characterized in that the said bracket having the ⌐ shape has the elongated slots provided on its left and right sides, also the connecting threaded holes and the sliding holes of the rods perpendicular to the elongated slots and passing through the upper arcuate surface of the elongated slots provided on the top of the bracket with the connecting bolt holes and the sliding holes of the pushing rods provided on the front and rear sides of the bracket and passed therethrough.

The multifunctional shoes for walking and skating with single roller are characterized in that the said roller made of elastic material has a bearing hole within which a single direction ball bearing is received and the roller is provided in the middle of the bracket.

The multifunctional shoes for walking and skating with single roller are characterized in that the shaft has a cylindrical shape with a flat boss provided on each of its both ends in the same direction, the shaft with its flat boss facing downward passes through the elongated slots of the bracket and the bearing received in the roller.

The multifunctional shoes for walking and skating with single roller are characterized in that the said rods are inserted into their sliding holes on the top of the bracket, and the springs placed on the upper flat bosses of the rods are also inserted into the sliding holes of the rods.

The multifunctional shoes for walking and skating with single roller are characterized in that a hole into which the pushing rod head is inserted is provided in the heel of the shoe body, and an assemblied roller assembly is fitted in the recess of the heel of the shoe body with the roller assembly and the shoe body being connected by the fastening bolts.

The invention has significant advantages when compared with the existing art. From the above description it can be seen that the multifunctional shoes for walking and skating with a single roller according to the invention have a recess provided in the heel of each shoe with a roller inside the recess which can be extended and retrieved in the direction perpendicular to the ground. When the roller is retrieved toward the wearer's body, the whole sole or the shoe contacts the grounds allowing the wearer to walk. When the roller is extended toward the ground, only the heel of the shoe and the roller contact the ground permitting skating or the performance of tricks. Because there is only one roller, the shoes are light and handy facilitating various performances of tricks to be executed and easy walking. Meanwhile, switching between walking and skating can be easily carried out by striking the rear parts of the shoes against a wall or other object if desired without the need of hands, thereby increasing the shoes's convenience. Therefore the invention has the multiple functions of walking, skating and trick performing.

From the above it is clear that significant improvements both in structure and function as well as technical advance have been achieved by the multifunctional shoes for walking and skating with a single roller of the invention.

The structure of the multifunctional shoes of the invention will be described in detail by means of the preferred embodiment and drawings as follows.

PREFERRED EMBODIMENT

Hereafter the invention will be described in detail by the preferred embodiment in conjunction with the drawings.

Figure 2:
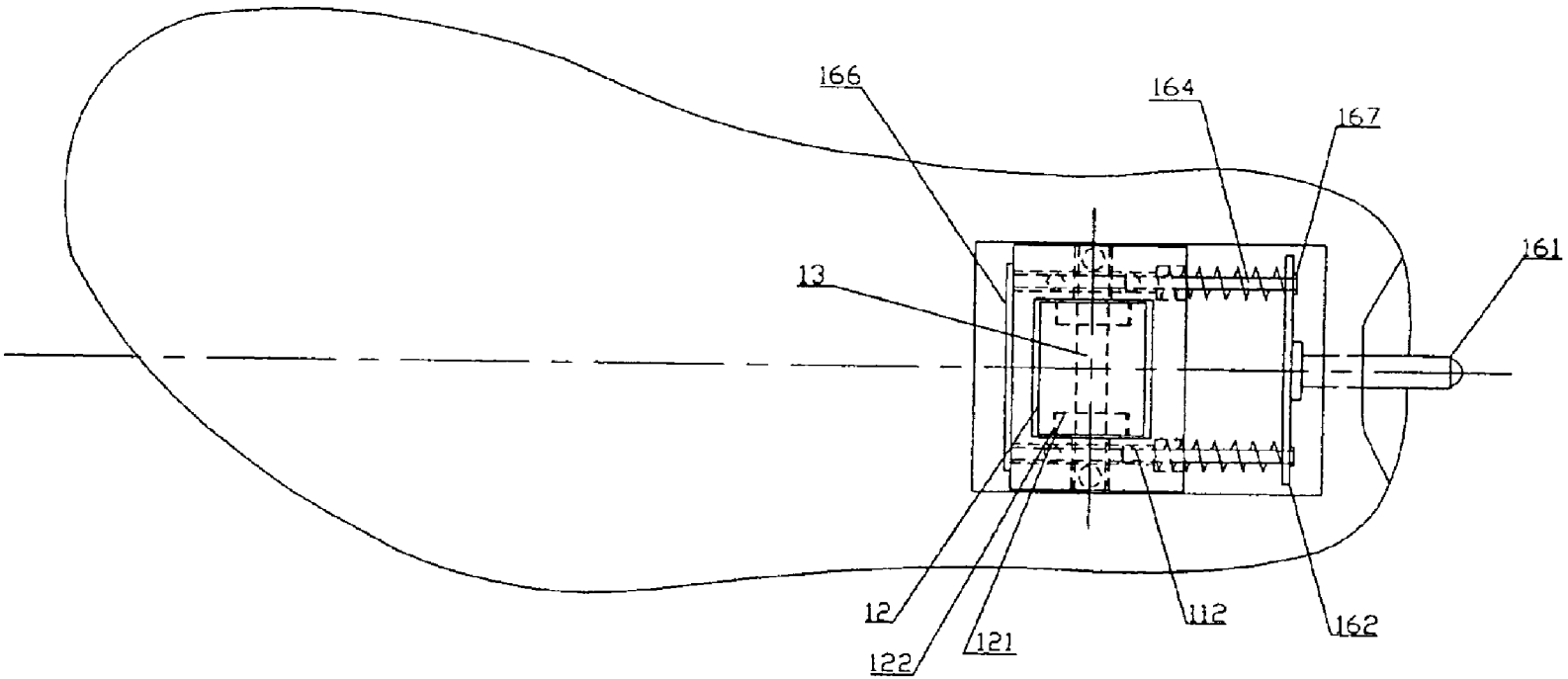
FIG. 2 is a schematic view of the roller assembly fitted with the shoes according to the invention.

Referring to FIG. 2, the multifunctional shoes for walking and skating with a single roller according to the invention mainly comprise a roller assembly 1 and a shoe body 2 wherein the roller assembly 1 is fitted with the shoe body 2 and walking as well as skating are performed by variation of the relative positions between the roller and the shoe body.

Figure 1:
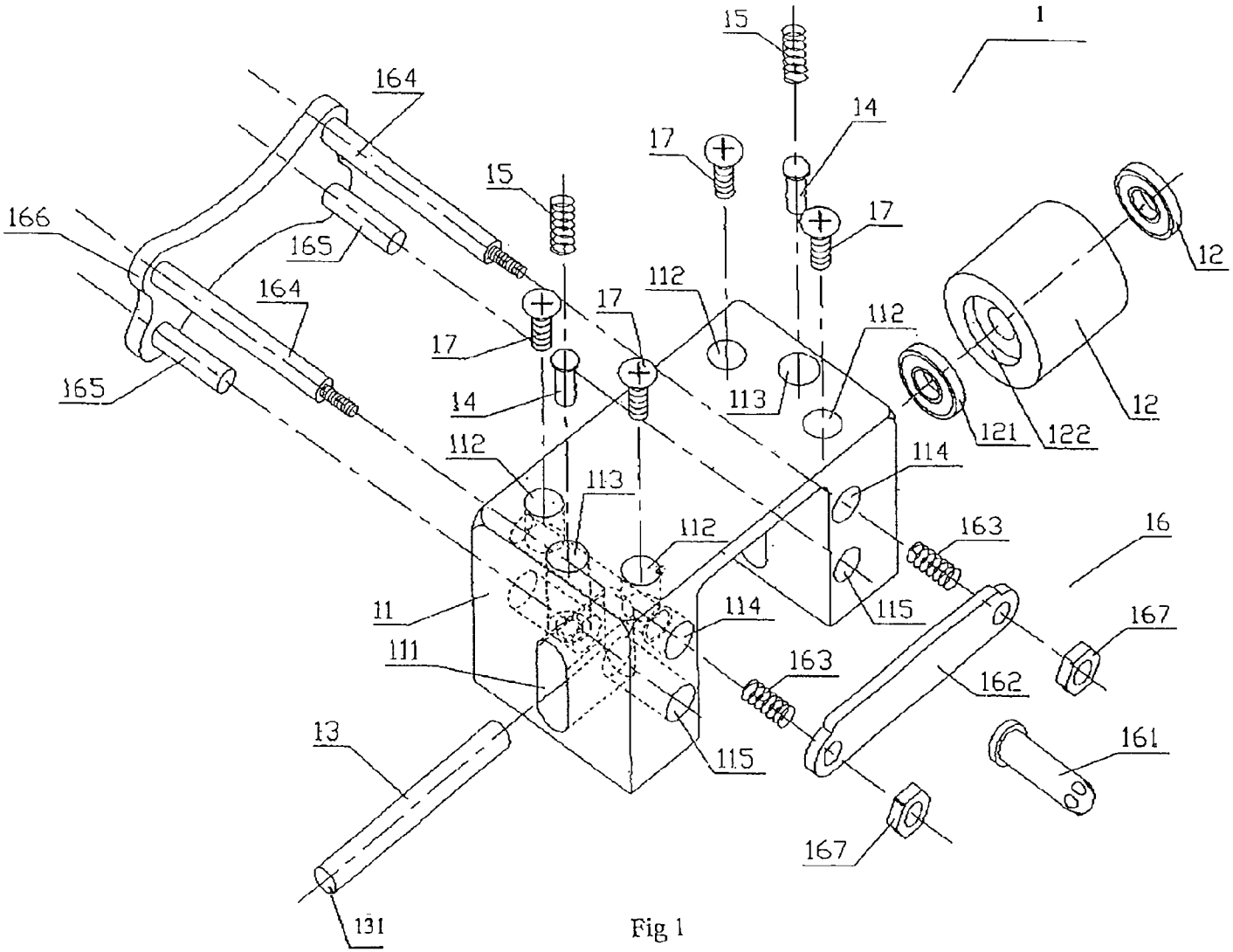
FIG. 1 is an exploded perspective view of the roller assembly according to the invention.
Figure 3:
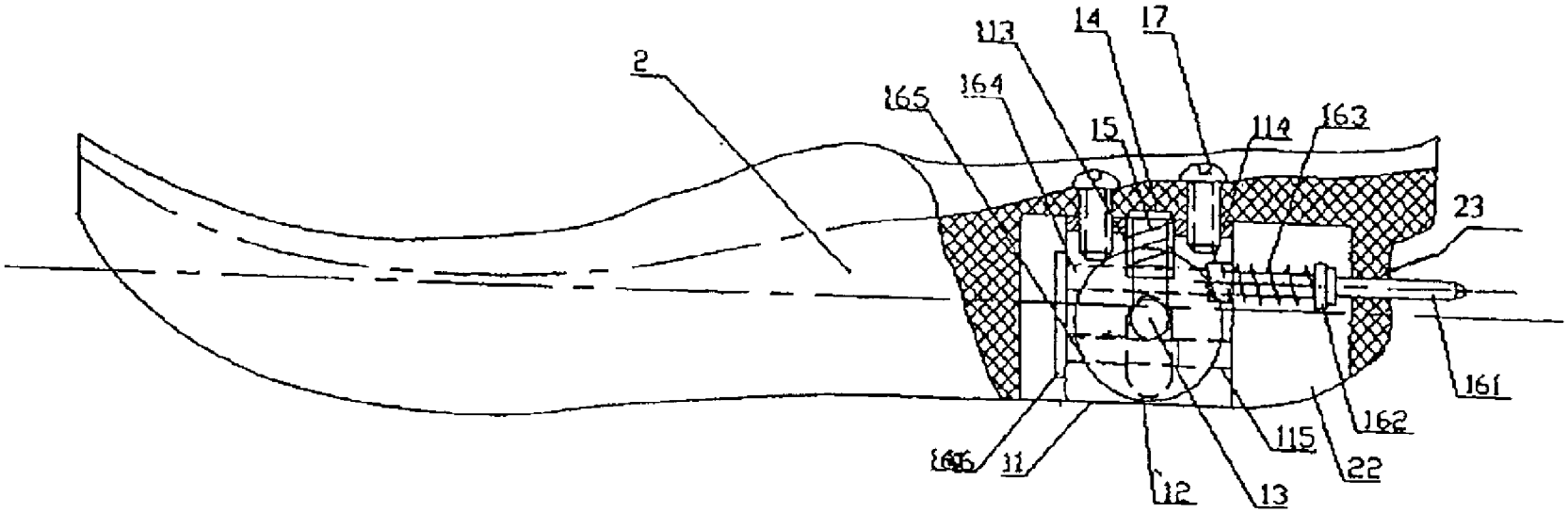
FIG. 3 is the partial section view of the roller assembly fitted with the shoes according to the invention.

As shown in FIG. 1 and FIG. 3, the roller assembly 1 comprises a bracket 11, a roller 12, a shaft 13, rods 14, springs 15, a pushing rod assembly 16, and fastening bolts 17 or the like. The shaft 13 passing through the center of the roller causes the roller 12 to be fixed to the middle of the bracket 11 on top of which rods 14 and springs 15 are provided. Also the pushing rod assembly 16 is secured to the bracket 11 by the nuts 167.

The bracket 11 has ⌐ shape, and at its left and right sides the elongated through slots 111 are coaxial with each other are provided. Threaded holes 112 and holes 113 for the displacement of the rod perpendicular to the slots 111 and passing through their upper arcuate surface are provided on the top of the bracket 11. There are threaded holes 114 for connecting the pushing rods and the sliding holes 115 that pass through the front and rear sides of the bracket 11.

The roller 12 made of elastic material is fitted in the middle of the bracket 11, and has a bearing hole 122 in which the single direction ball bearing 121 is received.

The single direction ball bearing 121 is pressed into the bearing hole 122, then the shaft 13 is passed successively through the elongated slot 111 on one side of the bracket 11, the single direction beating 121 and the elongated slot 111 on other side of the bracket 11. The shaft 13 together with the roller 12 can move perpendicularly upward and downward in the slots 111 varying the relative highness between the roller 12 and the bracket 11.

The cylindrical shaft 13 has a boss 131 provided at each of its ends in the same direction facing downward, and passes through the elongated slots 111 of the bracket 11 as wells as through the bearing 121 received in the roller 12.

Rods 14 are inserted into the sliding holes of the rods 113 on the top of the bracket 11 with the springs 15 which are placed on the upper bosses of the rods 14 that are respectively inserted in the holes 113.

The pushing rod assembly 16 consists of a pushing rod head 161, a rear connecting plate 162, spring 163, pushing rod connecting bolts 164, pushing rods 165, a front connecting plate 166 and the fastening nuts 167 with the pushing rod connecting bolts 164 and the pushing rods 165 welded with the front connecting plate 166.

The pushing rod connecting bolts 164 welded to the front connecting plate 166 are inserted into the holes 114 on the bracket 11 passing through the center of the springs 163, while the pushing rods 165 welded to the front connecting plate 166 are inserted into the sliding holes of the pushing rods 115. Also the pushing rod connecting bolts 164 are inserted into holes 1621 in the rear connecting plate 162 and are secured by the fastening nuts 167.

The pushing rod head 161 is inserted into the hole 23 on the heel of the shoe body 2, and the fitted roller assembly 1 received in the recess 22 on the heel of the shoe body 2 is secured with the shoe body 2 by the fastening bolt 17.

In the case of skating, the pushing rod bead 161 is pressed by force applied from outside, so that the rear connecting plate 162 and the connecting bolts of the pushing rods 164 that are secured to it are caused to move forward. Meanwhile, the front connecting plate 166 welded to the connecting bolts of the pushing rods 164 and the pushing rods 165 welded to the front connecting plate 166 move forward along the sliding holes of the pushing rods 115 on the bracket 11 in a horizontal direction. When the pushing rods 165 move forward apart from the elongated slots 111 of the bracket 11, the shaft 13 together with the roller 12 fixed at its move downward extending out from the recess 22 of the sole of the shoe body 2 due to the effect of the springs 15. At this time releasing the force applied to the pushing rod head 161, the spring 163 will press the pushing rod assembly 16 to move rearward along the connecting threaded holes 114 and the sliding holes 115 of the pushing rods as a whole, thus pressing the pushing rods 165 against the top of the shaft 13 and preventing the shaft 13 and the roller 12 fixed on it from movement upward and downward along the elongated slots 111 of the bracket 11. Therefore, skating and various tricks can be performed.

In the case of walking, the external force is applied to the pushing rod head 161 causing the rear connecting plate 162 and the connecting rods of the pushing rods 164 fixed on it to move forward, as well as the front connecting plate 166 welded to the connecting rods of the pushing rods 164 and the pushing rods 165 welded to the front connecting plated 166 to move forward horizontally along the sliding holes 115 of the pushing rods in the bracket 11. When the pushing rods 165 move forward apart from the elongated slats 111 in the bracket 11, the roller 12 is pressed against the ground by the heel of the shoe causing the roller 12 and the shaft 13 connected to it received in the elongated slots 111 of the bracket 11 to move upward, as a result the roller 12 is retrieved into the recess 22 of the soles of the shoe body 2. Releasing the force applied to the pushing rod head 161 accesses the springs 163 to move the pushing rod assembly 16 rearward along the connecting threaded holes 114 and the sliding holes 115 of the pushing rods as a whole, thus the pushing rods 165 are inserted underneath the shaft 13 preventing the roller 12 on the shaft 13 from movement upward and downward along the elongated slots 111 of the bracket 11.

What mentioned above is merely the preferred embodiment of the invention, and doesn't contribute any limitation to the invention. All the simple modifications or their equivalent and trimmings based essentially on the invention are within the scope of the invention.

What is claimed is:

1. Multifunctional shoes for walking and skating with a single roller comprising a roller assembly (1), a shoe body (2) wherein the roller assembly (1) is fitted in the shoe body (2); said roller assembly (1) comprises; a bracket (11), a roller (12), a shaft (13), rods (14), a first set of springs (15) for biasing said roller (12), pushing rods assembly (16), a second set of springs (163) for biasing said pushing rod assembly (16), wherein said first set of springs (15) biases said roller (12) in a direction perpendicular to the biasing direction of said second set of springs (163), and fastening bolts (17) with said shaft (13) passed through a center portion of said roller (12) thereby securing said roller (12) to a middle portion of said bracket (11); said rods (14) and said first set of springs (15) provided on a top portion of said bracket (11); said pushing rods assembly (16) provided on said bracket (11) and fixed by nuts (167) wherein said pushing rod assembly (16) comprises a pushing rod head (161), a rear connecting plate (162), said second set of springs (163), connecting bolts for a first set of pushing rods (164), a second set of pushing rods (165), a front connecting plate (166), and fastening nuts (167) with said connecting bolts for said first and second sets of pushing rods (164, 165) welded to said front connecting plate (166), and said second set of springs (163) seated on said connecting bolts for said first set of pushing rods (164).

2. Multifunctional shoes for walking and skating with a single roller according to claim 1 further comprising: said connecting bolts for said first set of pushing rods (164) attached to said front connecting plate (166) and passed through center portions of said second set of springs (163) and connecting threaded holes (114) in said bracket (11); said second set of pushing rods (165) welded to said front connections plate (166) and inserted into sliding holes (115) of said bracket (11); connecting bolts for said first set of pushing rods (164) inserted into holes of a rear connecting plate (162) and fixed by said fastening nuts (167).

3. Multifunctional shoes for walking and skating with a single roller according to claim 1 wherein said bracket (11) having elongated slots (111) provided on the left and right sides; connecting threaded holes (112) and sliding holes (113) of rods (14) perpendicular to said elongated slots (111) and passing through an upper arcuated surface of said elongated slots (111) provided on a top portion of said bracket (11) with connecting bolt holes (114) and sliding holes (115) of said pushing rods provided on the front and rear sides of said bracket (11) and passed there through.

4. Multifunctional shoes for walking and skating with a single roller according to claim 1 are wherein said roller (12) is made of elastic material and has a bearing hole (122) within which a single direction ball bearing (121) is received and said roller (12) is provided in the middle of the bracket (11).

5. Multifunctional shoes for walking and skating with a single roller according to claim 1 wherein said shaft (13) has a cylindrical shape with a flat boss (131) provided on each of its both ends in the same direction, said shaft (13) with its flat boss (131) facing downward passes through elongated slots (111) of said bracket (11) and a bearing (121) received in said roller (12).

6. Multifunctional shoes for walking and skating with a single roller according to claim 1 wherein said rods (14) are inserted into sliding holes (113) on the top of said bracket (11), and said first set of springs (15) are placed on upper flat bosses of said rods (14) and are also inserted into said sliding holes (113) of the rods (14).

7. Multifunctional shoes for walking and skating with a single roller according to claim 1 further comprising a hole (23) into which said pushing rod head (161) is inserted is provided in the heel of the shoe body (2), and an assembled roller assembly is fitted in a recess (22) of the heel of said shoe body (2) with said roller assembly (1) and said shoe body (2) connected by fastening bolts (17).

8. Multifunctional shoes for walking and skating with a single roller according to claim 1, wherein said pushing rod head (161) is tapered.

* * * * *

UNITED STATES PATENT AND TRADEMARK OFFICE

CERTIFICATE OF CORRECTION

PATENT NO. : 6,926,289 B2
DATED : August 9, 2005
INVENTOR(S) : Wang, Guohua

It is certified that error appears in the above-identified patent and that said Letters Patent is hereby corrected as shown below:

Column 2,
Line 67, "shoes's" should be changed to -- shoe's --.

Signed and Sealed this

Twenty-second Day of November, 2005

JON W. DUDAS
*Director of the United States Patent and Trademark Office*